US010859218B2

(12) United States Patent
Momin et al.

(10) Patent No.: US 10,859,218 B2
(45) Date of Patent: Dec. 8, 2020

(54) UNIVERSAL LIGHTING PAN WITH QUICK SPLICEBOX CONNECTION

(71) Applicant: ABL IP Holding LLC, Atlanta, GA (US)

(72) Inventors: Mohamed Momin, Scottsdale, GA (US); Mark Charles Major, Lithonia, GA (US); Kim Brown Smith, Conyers, GA (US)

(73) Assignee: ABL IP Holding LLC, Atlanta, GA (US)

( * ) Notice: Subject to any disclaimer, the term of this patent is extended or adjusted under 35 U.S.C. 154(b) by 0 days.

(21) Appl. No.: 16/356,269

(22) Filed: Mar. 18, 2019

(65) Prior Publication Data

US 2020/0300428 A1 Sep. 24, 2020

(51) Int. Cl.

| | |
|---|---|
| ***F21S 8/02*** | (2006.01) |
| ***F21V 23/00*** | (2015.01) |
| ***F21V 21/04*** | (2006.01) |
| ***F21V 23/02*** | (2006.01) |

(52) U.S. Cl.

CPC ..... *F21S 8/02* (2013.01); *F21V 21/04* (2013.01); *F21V 23/007* (2013.01); *F21V 23/023* (2013.01)

(58) Field of Classification Search

None

See application file for complete search history.

(56) References Cited

U.S. PATENT DOCUMENTS

| | | | | |
|---|---|---|---|---|
| 5,662,414 | A * | 9/1997 | Jennings | F21V 15/01 362/365 |
| 5,758,959 | A * | 6/1998 | Sieczkowski | F21S 8/026 362/148 |
| 5,800,050 | A * | 9/1998 | Leadford | F21V 21/04 362/296.08 |
| 2012/0044704 | A1* | 2/2012 | Wilson | F21S 8/026 362/365 |

OTHER PUBLICATIONS

"2.5" New Construction Plate", Beach Lighting, Available Online at: https://beachlightingusa.com/product/2-5-new-construction-plate/?wpp_export=pdf, Accessed from Internet on: May 6, 2016, 3 pages.

CA 3,037,017, "Office Action", dated Apr. 14, 2020, 5 pages.

* cited by examiner

*Primary Examiner* — Ashok Patel

(74) *Attorney, Agent, or Firm* — Kilpatrick Townsend & Stockton LLP

(57) ABSTRACT

A recessed lighting fixture assembly includes a mounting pan having a mounting structure that is configured to be coupled to a ceiling and a pan base coupled with the mounting structure. The pan base defines a pan opening and includes a first quick-connect mounting feature. The light fixture assembly includes a light fixture configured to be secured to the mounting pan such that a portion of the light fixture extends through the pan opening. The light fixture assembly includes an electrical junction box that is configured to supply power to the light fixture. The electrical junction box includes a second quick-connect mounting feature that is configured to engage with the first quick-connect mounting feature to secure the electrical junction box to the mounting pan.

6 Claims, 15 Drawing Sheets

UNIVERSAL LIGHTING PAN WITH QUICK SPLICEBOX CONNECTION

BACKGROUND OF THE INVENTION

Conventional mounting pans for light fixtures are designed to only work with a single size of light fixture, and oftentimes are designed to work only on drywall type ceilings. This necessitates the design and production of an array of mounting pans having different dimensions to satisfy the sizing requirements of different applications. Additionally, conventional mounting pans do not provide the ability to quickly mount and detach a junction box for the light fixture. As a result, during inspections and servicing of the light fixtures, it becomes necessary for the user to get their head very close to the mounting pan in order to inspect and/or service the light fixture. Such designs also make installation and servicing of the junction box difficult, as such procedures may need to be performed without much space to operate and possibly without a clear, direct line of sight to the component.

BRIEF SUMMARY OF THE INVENTION

Embodiments of the present invention provide mounting pans for lighting fixtures that are designed to accommodate light fixtures of various sizes. For example, mounting pans in accordance with the present invention may define a pan opening that may be adjustable in size and/or shape for use with a particular lighting fixture. Embodiments of the invention also provide quick-connect mounting mechanisms on mounting pans and electrical junction boxes that allow the electrical junction boxes to be quickly and easily engaged and disengaged from the mounting pan. For example, the quick-connect mechanisms may include keyhole slots that interface with studs to secure the mounting pan and electrical junction boxes together.

In one embodiment, a recessed lighting fixture assembly is provided. The assembly may include a mounting pan having a mounting structure that is configured to be coupled to a ceiling and a pan base coupled with the mounting structure. The pan base may define a pan opening. The pan base may include a first quick-connect mounting feature. The assembly may also include a light fixture configured to be secured to the mounting pan such that a portion of the light fixture extends through the pan opening and an electrical junction box that is configured to supply power to the light fixture. The electrical junction box may include a second quick-connect mounting feature that is configured to engage with the first quick-connect mounting feature to secure the electrical junction box to the mounting pan.

In some embodiments, the first quick-connect mounting feature or the second quick-connect mounting feature may include a plurality of elongated slots. Each of the elongated slots may have a first end and a second end with the first end being larger than the second end. The other of the first quick-connect mounting feature or the second quick-connect mounting feature may include a plurality of protruding studs. Each of the protruding studs may have a head, with the head having a larger diameter than the second end of an elongated slot and a smaller diameter than the first end of an elongated slot. Each head may be configured to be inserted into the first end of one of the plurality of elongated slots and slid toward the second end to secure the head within the one of the plurality of elongated slots. In some embodiments, each of the protruding studs may include a friction element positioned between the head and a surface of the another one of the first quick-connect mounting feature or the second quick-connect mounting feature. The friction element may be configured to maintain the head at a position within the elongated slot. In some embodiments, the first quick-connect mounting feature comprises a plurality of connectors spaced apart from one another to provide multiple mounting positions for the electrical junction box. At least some of the plurality of connectors may optionally be spaced apart at irregular intervals.

In some embodiments, the mounting pan may include at least one slot formed a distance from the pan opening. The slot may not be entirely continuous. Rather, in such embodiments the slots are formed such that one or more retention tabs extend between portions of the mounting pan on each side of the slot. The retention tabs are configured to be cut to remove a portion of the pan base positioned between the slot and the pan opening, thereby expanding a size of the pan opening.

In another embodiment, a mounting pan for securing a light fixture to a ceiling is provided. The mounting pan may include a mounting structure that is configured to be coupled to a ceiling and a pan base coupled with the mounting structure. The pan base may define a pan opening that is configured to receive a portion of a light fixture. The pan base may include a quick-connect mounting feature that is configured to slidingly receive a portion of an electrical junction box to secure the electrical junction box to the light fixture.

BRIEF DESCRIPTION OF THE DRAWINGS

A further understanding of the nature and advantages of various embodiments may be realized by reference to the following figures. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION OF THE INVENTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Embodiments of the present invention are directed to mounting pans for light fixtures. The mounting pans described herein are designed such that a single mounting pan is compatible for use with a number of different sizes of light fixtures. For example, the mounting pans may include a number of pre-cut aperture punch outs that allow an aperture size of the mounting pan to be quickly adjusted to fit a particular light fixture. Additionally, the mounting pans described herein may have quick-connect mechanisms that allow for a remote junction box to be quickly removed and affixed to the mounting pan. Some embodiments of the invention may utilize a quick-connect mechanism that includes one or more mechanical studs having partially or fully protruding heads, that are offset a specified distance from the surface of the mounting pan. These studs may interface with keyed slots on the junction box to removably secure the junction box to the mounting pan. In some embodiments, a flexible, malleable element may be retained on the protruding heads to maintain the protruding heads at a desired position within the keyed slots to help prevent the junction box from sliding relative to the mounting pan when not acted upon by a human. Such designs enable the quick and simple mounting and detachment of the junction box, which can easily be performed with limited sightlines or even no direct view of the junction box itself. Moreover, embodiments of the present invention eliminate the need to use any tools to attach or detach the junction box to the mounting pan. The mounting pans described herein may also be used in both drywall or t-grid ceilings.

Figure 1A:
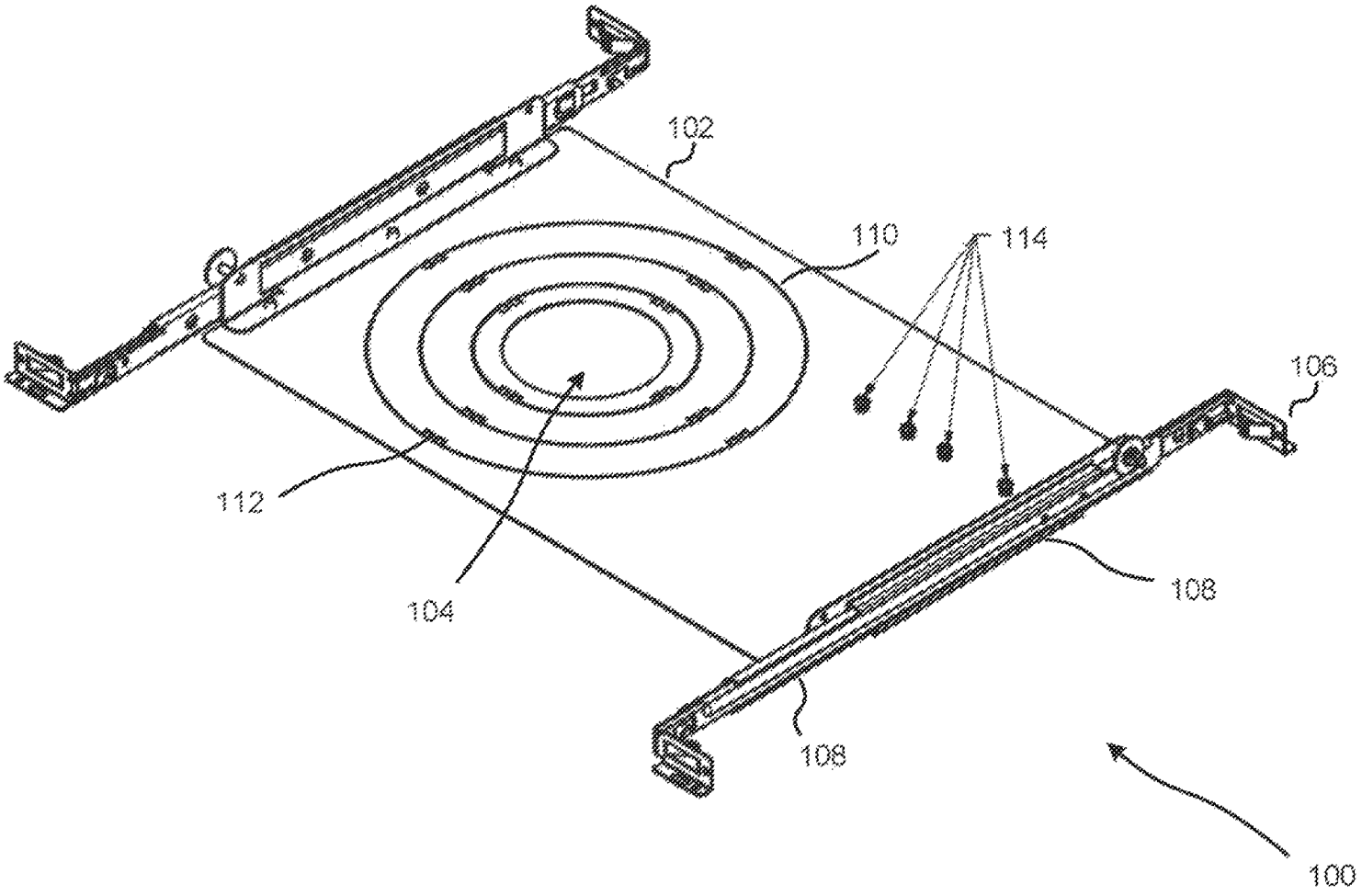
FIG. 1A is a left side isometric view illustrating a mounting pan with a quick-connect mounting mechanism according to embodiments of the invention.
Figure 1B:
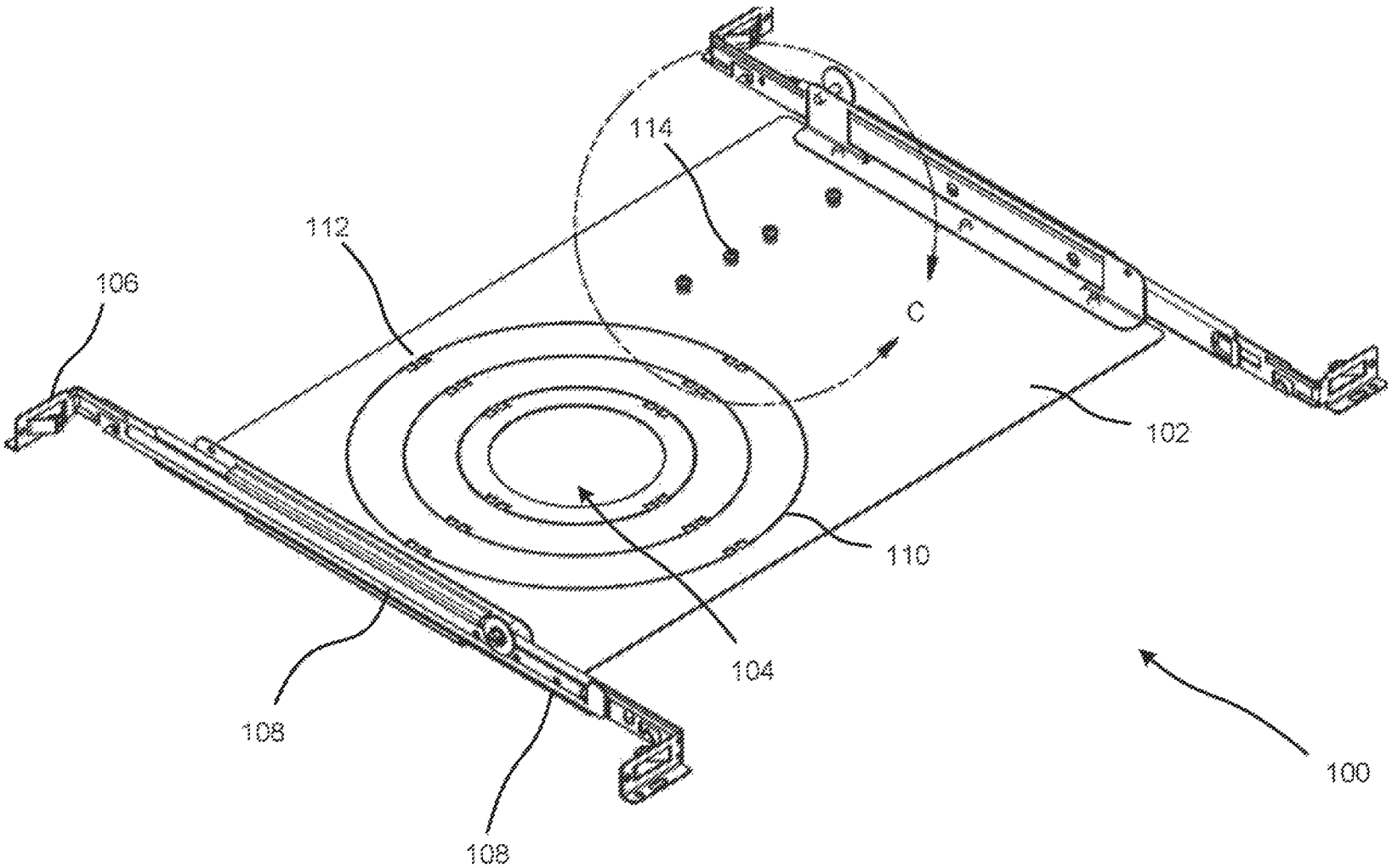
FIG. 1B is a right side isometric view of the mounting pan of FIG. 1A.
Figure 1C:
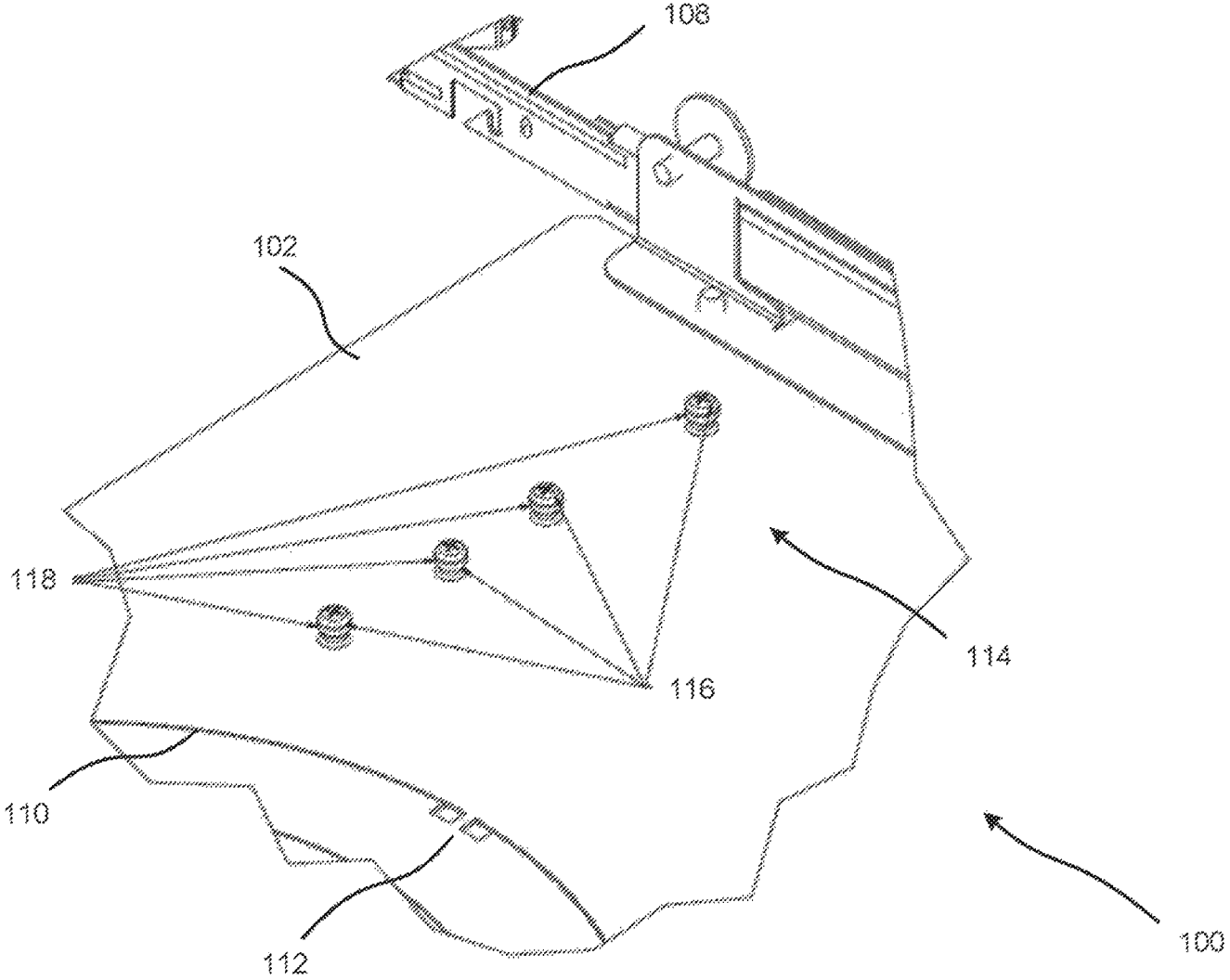
FIG. 1C is an enlarged view of the quick-connect mounting mechanism of the mounting pan of FIG. 1A.

FIGS. 1A-1C illustrates one embodiment of a mounting pan 100 for mounting a light fixture to a ceiling. As illustrated in FIG. 1A, the mounting pan 100 includes a pan base 102 that defines a pan opening 104 in which a light fixture may be mounted. While shown here having a circular pan opening 104 for mounting circular light fixtures, it will be appreciated that pan opening 104 may have other shapes to receive light fixtures of various shapes. The mounting pan may be made from any suitably rigid material, including metal, wood, and/or plastic. One or more slots 110 may be formed in the mounting pan 100. The slots 110 extend around an outer periphery of the pan opening 104 and surround a portion of material of the pan base 102 that is positioned between the respective slot 110 and the pan opening 104 (and/or another slot 110). Typically, slots 110 are the same shape as the pan opening 104, however in some embodiments the slots 110 may have different shapes than the pan opening 104, while in other embodiments both slots 110 having the same shape and different shapes may be included on the pan base 102. For example, the pan opening 104 may be circular in shape, while some of the slots 110 are rectangular in shape and other slots 110 are circular in shape. In some embodiments, the slots 110 nest within each other.

The slots 110 may be not be continuous in some embodiments. Rather, in such embodiments the slots are formed such that one or more retention tabs 112 are provided in discrete locations along a slot 110 so as to extend between and thus connect portions of the mounting pan on each side of the slot 110. In other words, the retention tabs 112 prevent a slot 110 from entirely severing the portion of the pan base 102 located between the slot 110 and the pan opening 104. Oftentimes, the one or more slots 110 are sized to match common sizes of light fixtures, while the original pan opening 104 is sized for a fairly small common light fixture size. When using mounting pan 100 to secure a large and/or different sized light fixture, a user may identify which slot 110 matches the size of the light fixture and may cut or otherwise sever the retention tabs 112 of that particular slot 110, which allows the user to remove any material of the pan base 102 that is positioned inward of the particular slot 110, thereby increasing the size and possibly altering the shape of the pan opening 104 to match a size and shape of the light fixture. In this manner, a single mounting pan 100 may be usable with any number of light fixture sizes and shapes.

Mounting pan 100 may be secured to a ceiling structure using mounting brackets 106. For example, opposing ends of each mounting bracket 106 may be fastened to adjacent ceiling joists or other structural features of the ceiling to secure the mounting pan 100 onto the ceiling structure. In some embodiments, the mounting brackets 106 may be adjustable so as to be adaptable for different ceiling designs. For example, the mounting brackets 106 may include multiple rails 108 that are slidingly engaged with one another to set a length of the mounting bracket 106. Once at the desired length, the rails 108 may be locked to prevent further sliding, such as by tightening a set screw and/or other locking mechanism.

The mounting pan 100 may also include at least one quick-connect mounting mechanism for securing an electrical junction box to the mounting pan 100. In the illustrated embodiment, the quick-connect mounting mechanism includes a number of protruding studs 114, which may be formed from screws and/or other objects. Each stud 114 may include a head 116 that projects upward from the pan base 102 via a shaft (not shown) as best illustrated in FIG. 1C. The studs 114 may be spaced apart from one another along a surface of the pan base 102 at regular and/or irregular intervals. By including a number of studs 114, a number of mounting locations for electrical junction boxes are provided. In some embodiments, irregular intervals of studs 114 may be used to not only provide for different mounting locations, but may also accommodate electric junction boxes of various sizes.

In some embodiments, each stud 114 may include a friction element 118 positioned between the head 116 and a surface of the pan base 102. For example, an O-ring, rubber grommet, and/or other high friction object may be positioned on the stud 114. In other embodiments, at least a lower surface of each head 116 may be coated with a high friction material, such as a rubber, to create a friction element 118 that is affixed to each stud 114. The friction element 118 is used to increase the friction between the stud 114 and corresponding quick-connect mounting feature of the electrical junction box when the electrical junction box is mounted on the mounting pan 100. This increased friction helps hold the electrical junction box in place relative to the mounting pan 100 until a user actively disengages the quick-connect mounting features from one another. The use of friction elements 118 also helps to eliminate the need for tools or other equipment to engage and/or disengage the quick-connect mounting features, as the friction elements 118 provide sufficient force to maintain the electrical junction box in a desired position once installed by a user, but also produce a sufficiently small holding force that allows a user to quickly and easily disengage and remove the electrical junction box from the mounting pan 100.

In embodiments in which each stud 114 is in the form of a screw and/or other threaded and/or adjustable member, the height that the head 116 extends above the surface of the pan base 102 may be adjusted, such as by tightening and/or loosening the screw. The relative distance between a lower surface of the head 116 and the upper surface of the pan base 102 (and where applicable, the friction element 118) may determine the amount of force applied to the electrical junction box to maintain the electrical junction box at a given position relative to the pan base 102. For example, as the distance decreases, the greater the force applied by the head 116 and/or friction element 118 to the electrical junction box.

It will be appreciated that in some embodiments the quick-connect mounting mechanism may include all the studs 114 provided on a mounting pan 100. In other embodiments a single quick-connect mounting mechanism may include only a subset of the total number of studs 114 provided on the mounting pan 100. As just one example, a single quick-connect mounting mechanism may utilize 3 studs 114, while 6 studs 114 are provided on a mounting pan 100. In such embodiments, the mounting pan 100 may be considered to have multiple quick-connect mounting mechanisms if the number of studs 114 exceeds the number of studs 114 needed for a single mounting position for an electrical junction box. In some embodiments, multiple quick-connect mounting mechanisms may share a single stud 114 and/or subset of studs 114. As just one example, a mounting pan 100 may include four studs 114 spaced at equal and/or irregular intervals, with each electrical junction box needing two studs 114 for mounting to the pan base 102. In such embodiments, a middle quick-connect mounting mechanism may share one stud 114 with each of the outer quick-connect mounting mechanisms. It will be appreciated that some or all of the quick-connect mounting mechanisms on a single mounting pan 100 may have studs 114 with the same relative spacing between one another, while in other embodiments, some or all of the quick-connect mounting mechanisms may have studs 114 at different intervals. Additionally, in some embodiments, some or all of the quick-connect mounting mechanisms on a single mounting pan 100 may include different numbers of studs 114.

Figure 2A:
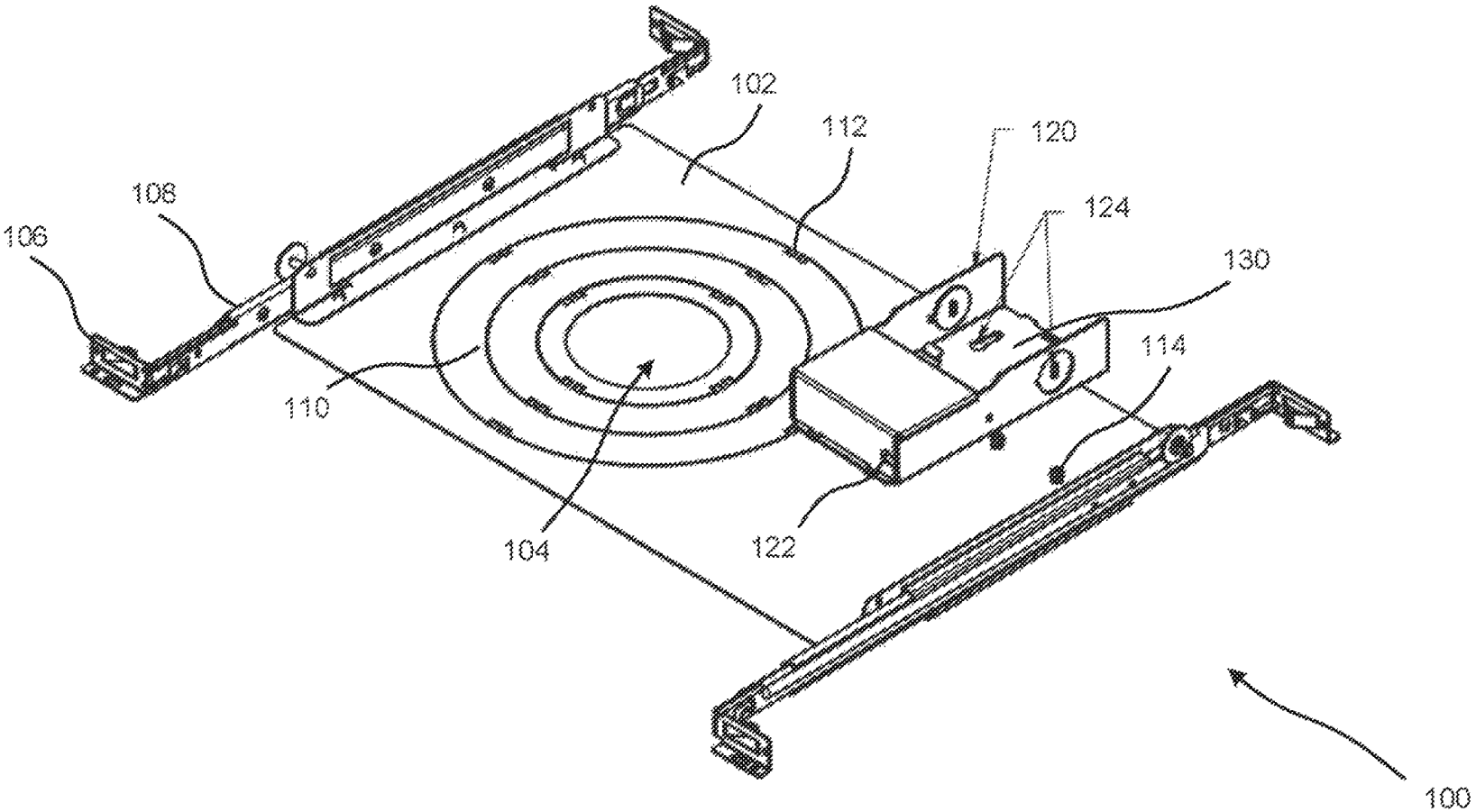
FIG. 2A illustrates an electrical junction box positioned in alignment with the quick-connect mechanism of the mounting pan of FIG. 1A.
Figure 2B:
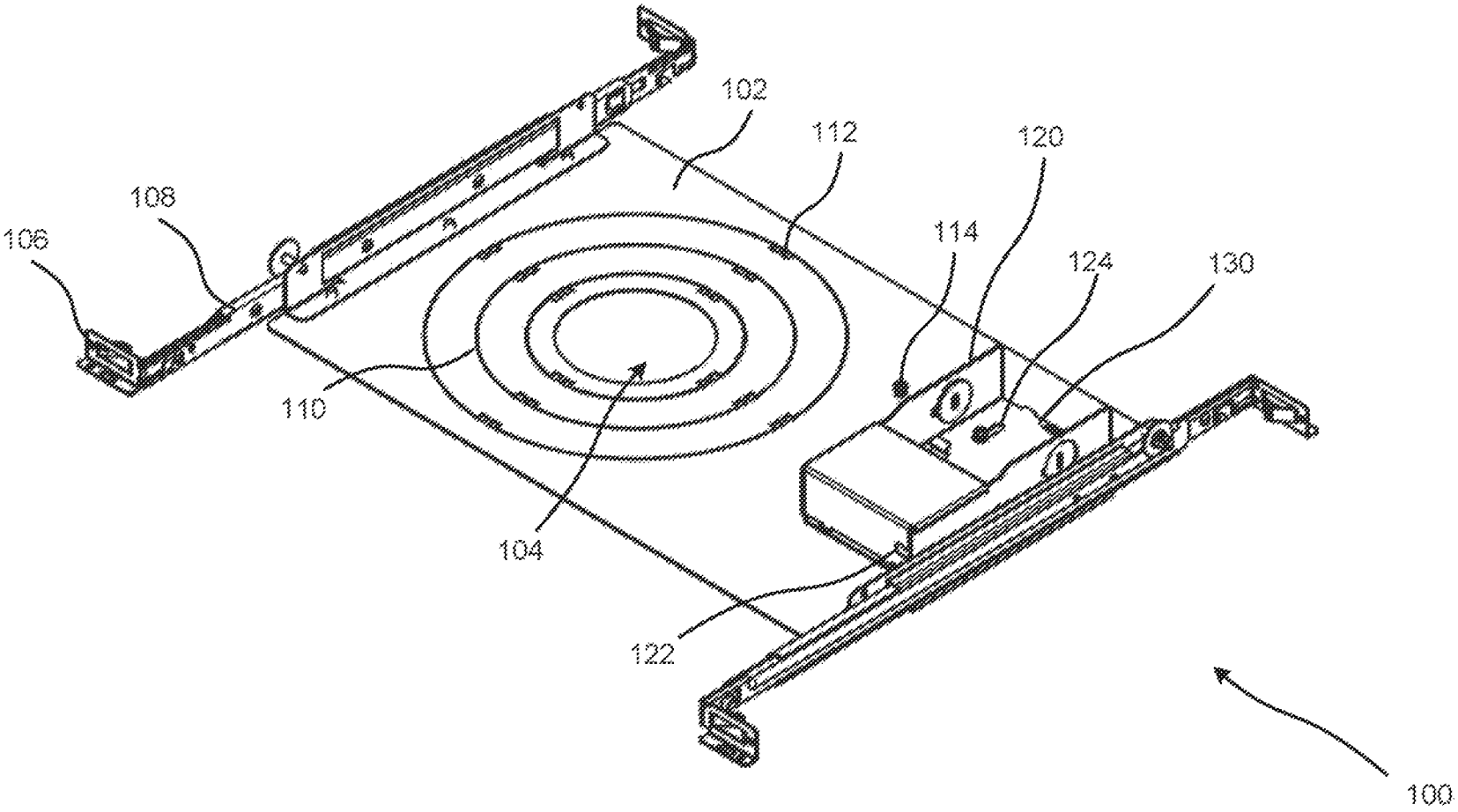
FIG. 2B illustrates the quick-connect mounting mechanism of the mounting pan of FIG. 1A in partial engagement with the electrical junction box.
Figure 2C:
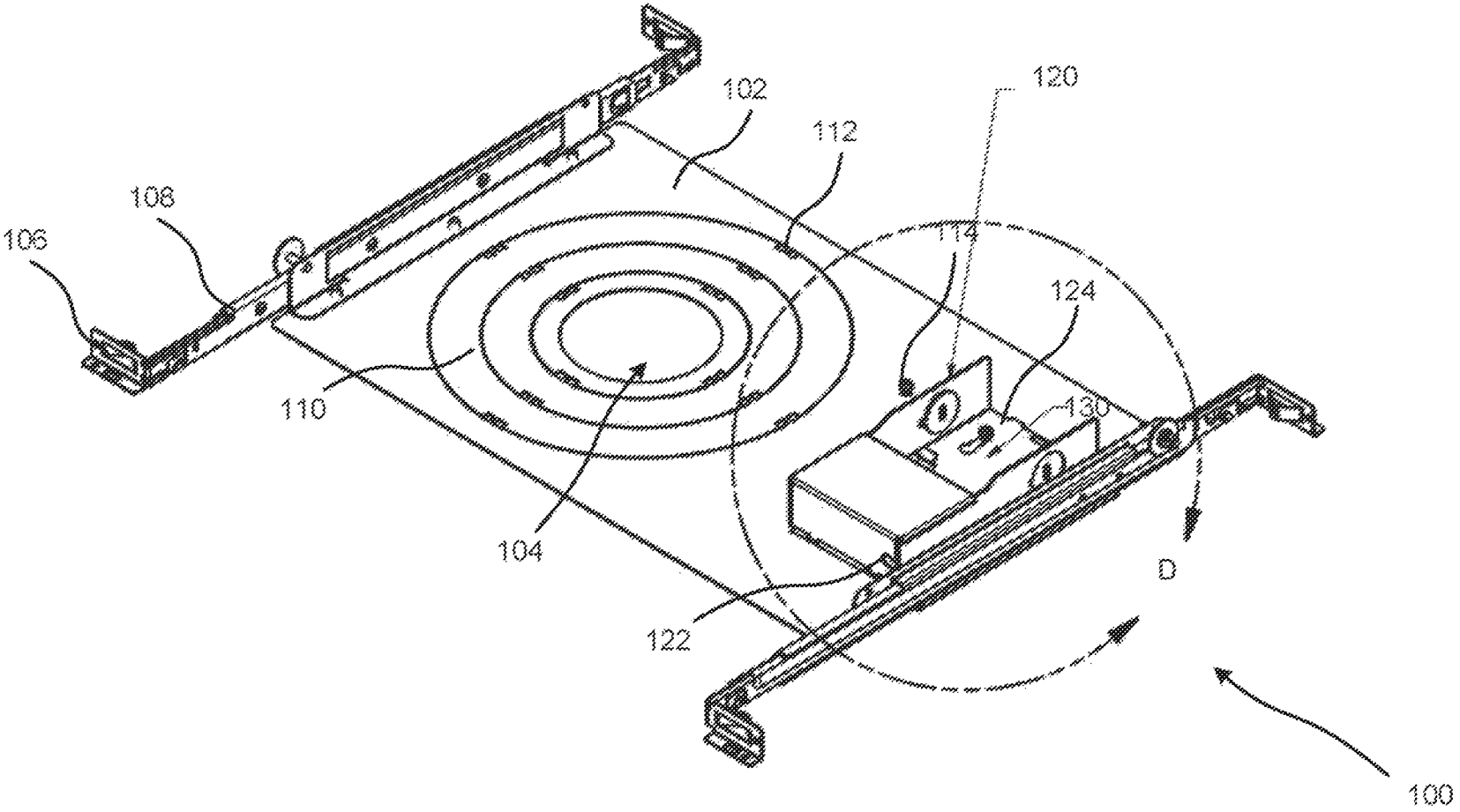
FIG. 2C illustrates the quick-connect mounting mechanism of the mounting pan of FIG. 1A in full engagement with the electrical junction box.
Figure 2D:
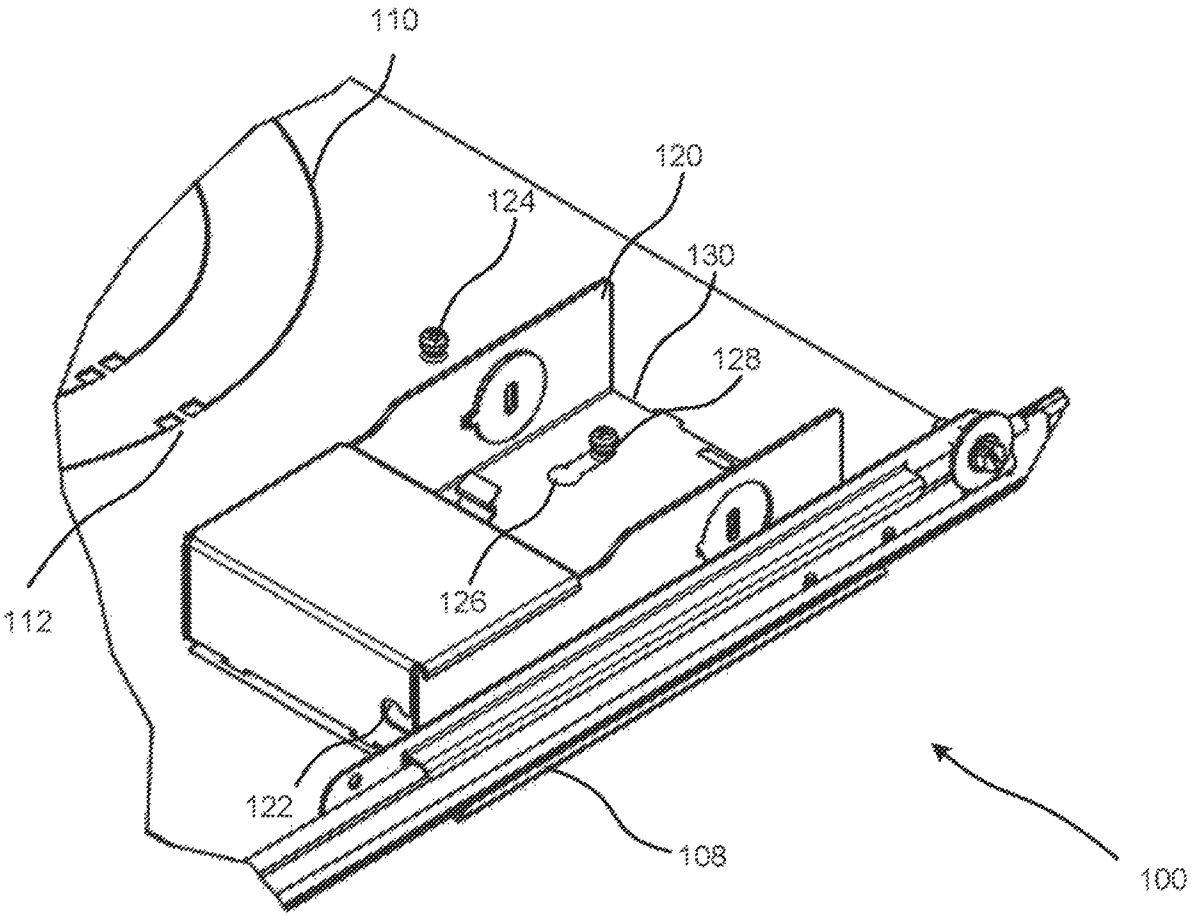
FIG. 2D is an enlarged view of the quick-connect mounting mechanism engagement shown in FIG. 2C.
Figure 2E:
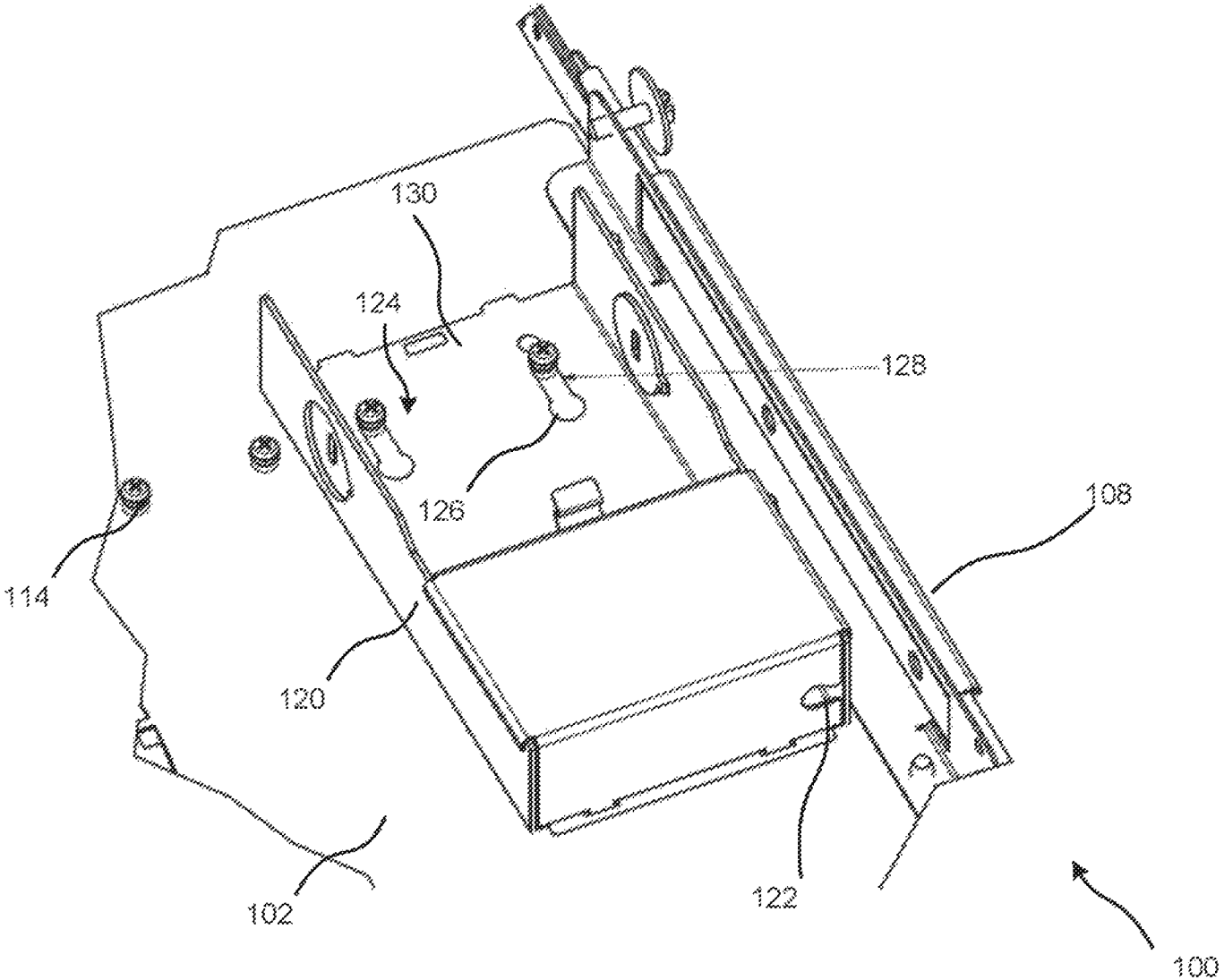
FIG. 2E is a front isometric close-up view of the quick-connect mounting mechanism engagement shown in FIG. 2C.

FIGS. 2A-2E illustrate an electrical junction box 120 being interfaced with the mounting pan 100 of FIG. 1. Here, electrical junction box 120 defines at least one electrical port 122 that provides a location for a connector to electrically couple the electrical junction box 120 to a light fixture mounted on the mounting pan 100. Electrical junction box 120 further includes at least one quick-connect mounting mechanism that interfaces with the quick-connect mounting mechanism of the mounting pan 100. As illustrated, the quick-connect mounting mechanism of the electrical junction box 120 includes a number of slots 124 that are defined in a base 130 of the electrical junction box 120. The slots 124 may be elongate and may include a wider first portion 126 (such as at a first end of the slot 124) and a narrower second portion 128 (such as at a second end of the slot 124). As best illustrated in FIG. 2E, the slots 124 are in the form of keyhole slots, with the first portion 126 defining a large opening and the second portion 128 defining an elongate slot having a smaller width than the first portion 126. While illustrated with the elongate slot having a single width across its length, in some embodiments the width may vary along at least a portion of the length of the elongate slot. For example, in some embodiments, the elongate slot may taper inward (at a constant rate and/or variable rate) from an edge of the first portion 126 to an end of the second portion 128.

To interface the quick-connect mechanisms from the electrical junction box 120 and the mounting pan 100, the electrical junction box 120 may be positioned above the mounting pan 100 such that the first portion 126 of each slot 124 is positioned above and in alignment with a respective one of the studs 114 on the mounting pan as shown in FIG. 2A. The first portion 126 of each slot 124 may be configured to receive the head 116 of one of the studs 114 of the mounting pan 100 as shown in FIG. 2B. Once the heads 116 are inserted through each of the first portions 126 of the slots 124, the electrical junction box 120 may be slid relative to the mounting pan 100 in a direction that moves the head 116 of each stud 114 toward the second portion 128 of each slot 124 until a shaft of each stud 114 contacts an end of the second portion 128 as shown in FIGS. 2C-2E. The heads 116 are designed to have a wider dimension than the width of the second portion 128 such that when positioned within the second portion 128, a portion of each of the heads 116 extends beyond an outer periphery of the second portion 128 of each slot 124 so as to prevent the electrical junction box 120 from being lifted relative to the mounting pan 100. When the studs 114 are engaged within the second portion 128 of the slots 124, the sidewalls and end wall of the second portion 128 of the slots 124 obstruct movement of the studs 114, allowing only movement of the studs 114 in the direction of the first portion 126. In this position, the heads 116 and/or friction elements 118 may be positioned against a top surface of the base 130 so as to create friction that prevents the electrical junction box 120 from sliding relative to the mounting pan 100 until sufficient force is applied to overcome the friction, such as when a user tries to slide the electrical junction box 120 in a direction relative to the mounting pan 100 that draws the studs 114 toward the first portion 126 of the slots 124.

Figure 3:
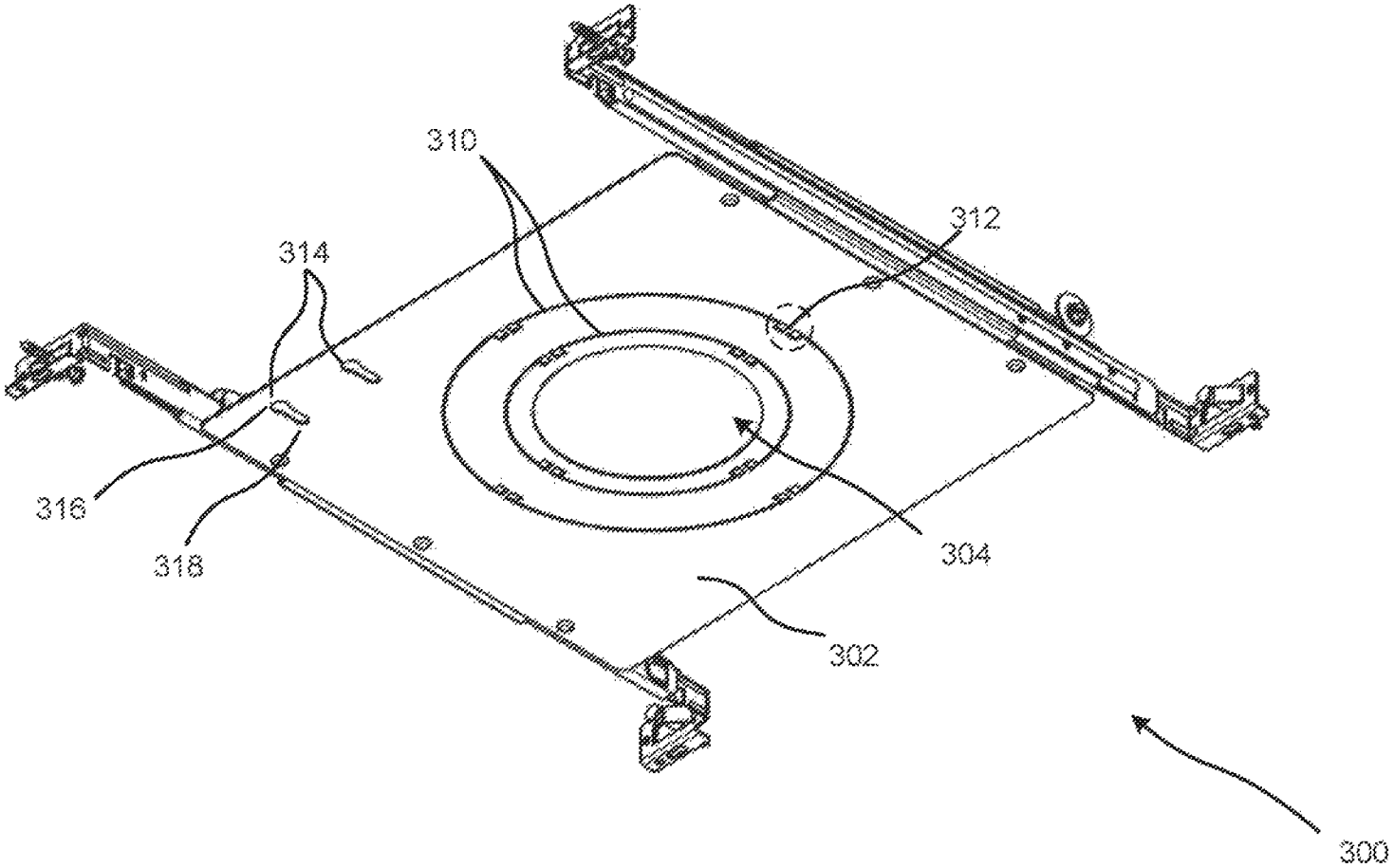
FIG. 3 is a bottom isometric view illustrating a mounting pan with a quick-connect mounting mechanism according to embodiments of the invention.

In some embodiments, the quick-connect mounting mechanisms may be reversed such that studs extending from a base of the electrical junction box may be interfaced with slots formed in a mounting pan to secure the electrical junction box onto the mounting pan. FIG. 3 illustrates an alternative embodiment of a mounting pan 300 for mounting a light fixture to a ceiling. Mounting pan 300 may be similar to mounting pan 100 described above and may include the same or similar features. For example, mounting pan 300 includes a pan base 302 that defines a pan opening 304 in which a light fixture may be mounted. While shown here having a circular pan opening 304 for mounting circular light fixtures, it will be appreciated that pan opening 304 may have other shapes to receive light fixtures of various shapes. The mounting pan may be made from any suitably rigid material, including metal, wood, and/or plastic. The mounting pan 300 may define one or more slots 310 that extend around an outer periphery of the pan opening 304 and surround a portion of material of the pan base 302 that is positioned between the respective slot 310 and the pan opening 304 (and/or another slot 310). The slots 310 may be not be continuous in some embodiments. Rather, in such embodiments the slots are formed such that one or more retention tabs 312 are provided in discrete locations along a slot 310 so as to extend between and thus connect portions of the mounting pan on each side of the slot 310. In other words, the retention tabs 312 prevent a slot 310 from entirely severing the portion of the pan base 302 located between the slot 110 and the pan opening 104. As described above, retention tabs 312 may be severed to allow the size and/or shape of the pan opening 304 to be altered to accommodate different sizes/shapes of light fixtures.

The mounting pan 300 may also include at least one quick-connect mounting mechanism for securing an electrical junction box to the mounting pan 300. As illustrated, the quick-connect mounting mechanism of the mounting pan 300 includes a number of slots 314 that are defined in the pan base 302. The slots 314 may be elongate and may include a wider first portion 316 (such as at a first end of the slot 314) and a narrower second portion 318 (such as at a second end of the slot 314). Slots 314 may be in the form of keyhole slots, with the first portion 316 defining a large opening and the second portion 318 defining an elongate slot having a smaller width than the first portion 316. While illustrated with the elongate slot having a single width across its length, in some embodiments the width may vary along at least a portion of the length of the elongate slot. For example, in some embodiments, the elongate slot may taper inward (at a constant rate and/or variable rate) from an edge of the first portion 316 to an end of the second portion 318. The slots 314 may be spaced apart from one another along a surface of the pan base 302 at regular and/or irregular intervals. By including a number of slots 314, a number of mounting locations for electrical junction boxes are provided. In some embodiments, irregular intervals of slots 314 may be used to not only provide for different mounting locations, but may also accommodate electric junction boxes of various sizes.

It will be appreciated that in some embodiments the quick-connect mounting mechanism may include all the slots 314 provided on a mounting pan 300. In other embodiments a single quick-connect mounting mechanism may include only a subset of the total number of slots 314 provided on the mounting pan 300. As just one example, a single quick-connect mounting mechanism may utilize 3 slots 314, while 6 slots 314 are provided on a mounting pan 300. In such embodiments, the mounting pan 300 may be considered to have multiple quick-connect mounting mechanisms if the number of slots 314 exceeds the number of slots 314 needed for a single mounting position for an electrical junction box. In some embodiments, multiple quick-connect mounting mechanisms may share a single slot 314 and/or subset of slots 314. As just one example, a mounting pan 300 may include four slots 314 spaced at equal and/or irregular intervals, with each electrical junction box needing two slots 314 for mounting to the pan base 302. In such embodiments, a middle quick-connect mounting mechanism may share one slot 314 with each of the outer quick-connect mounting mechanisms. It will be appreciated that some or all of the quick-connect mounting mechanisms on a single mounting pan 300 may have slots 314 with the same relative spacing between one another, while in other embodiments, some or all of the quick-connect mounting mechanisms may have slots 314 at different intervals. Additionally, in some embodiments, some or all of the quick-connect mounting mechanisms on a single mounting pan 300 may include different numbers of slots 314.

Figure 4A:
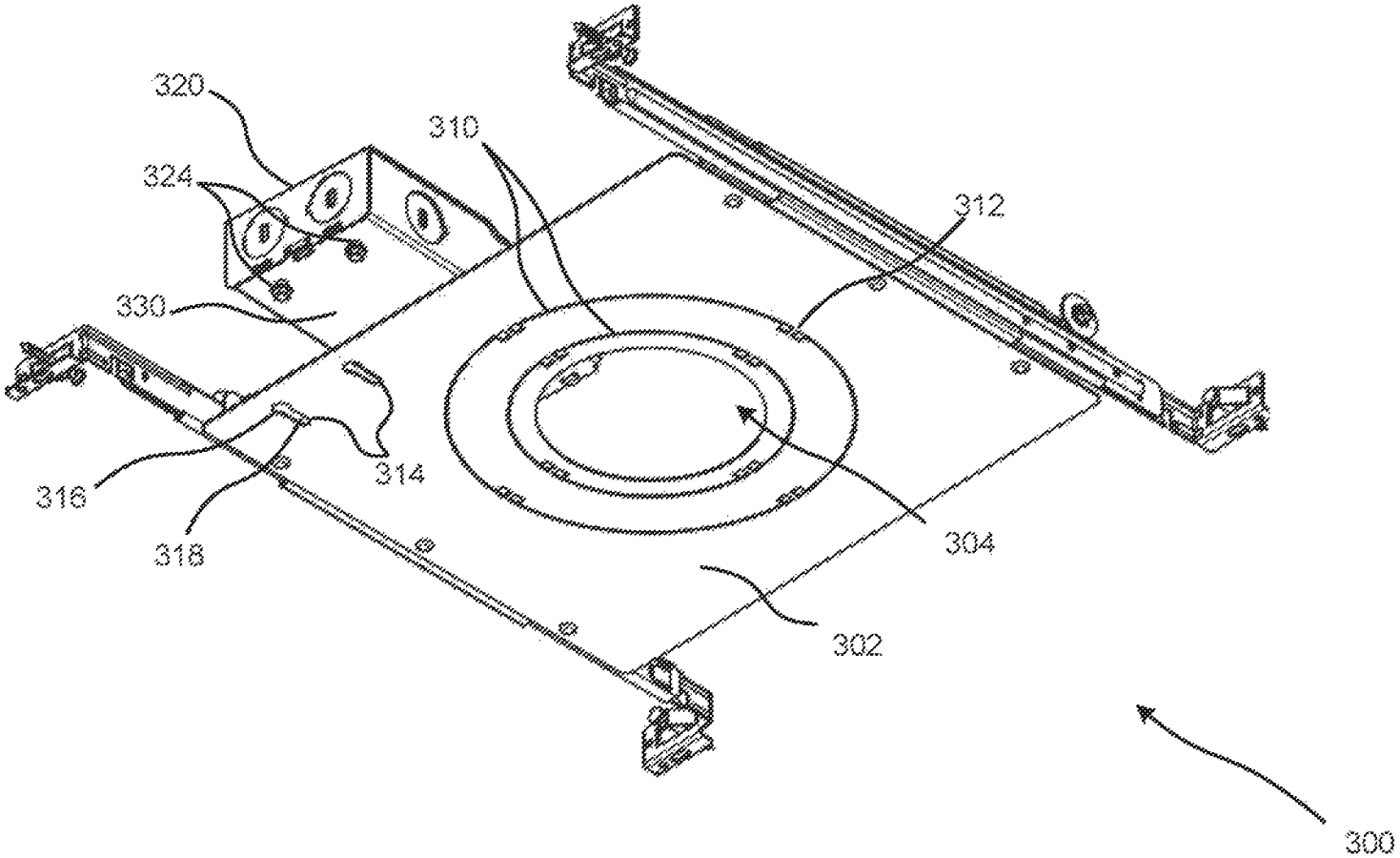
FIG. 4A illustrates an electrical junction box positioned in alignment with the quick-connect mechanism of the mounting pan of FIG. 3.
Figure 4B:
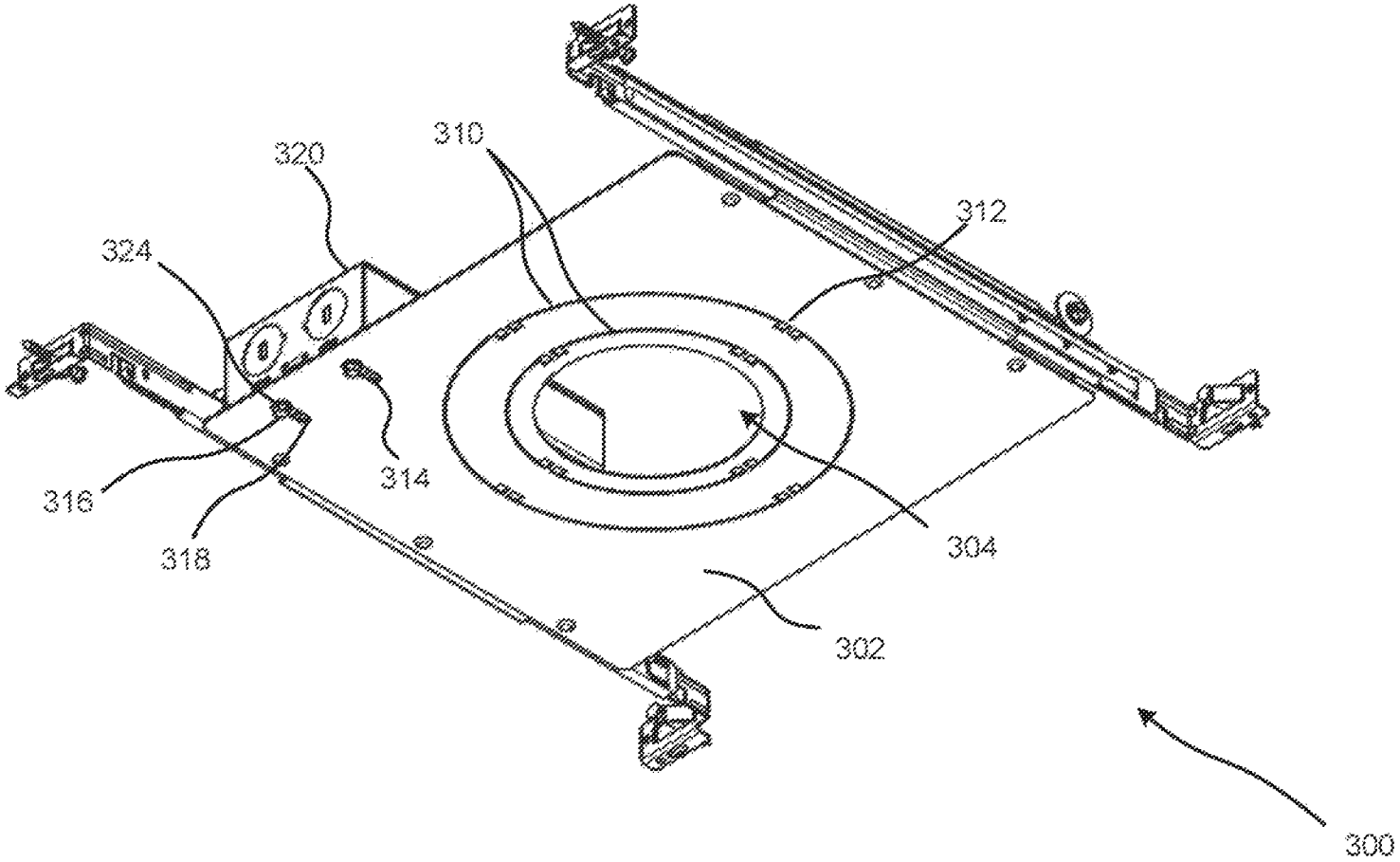
FIG. 4B illustrates the quick-connect mounting mechanism of the mounting pan of FIG. 3 in partial engagement with the electrical junction box.
Figure 4C:
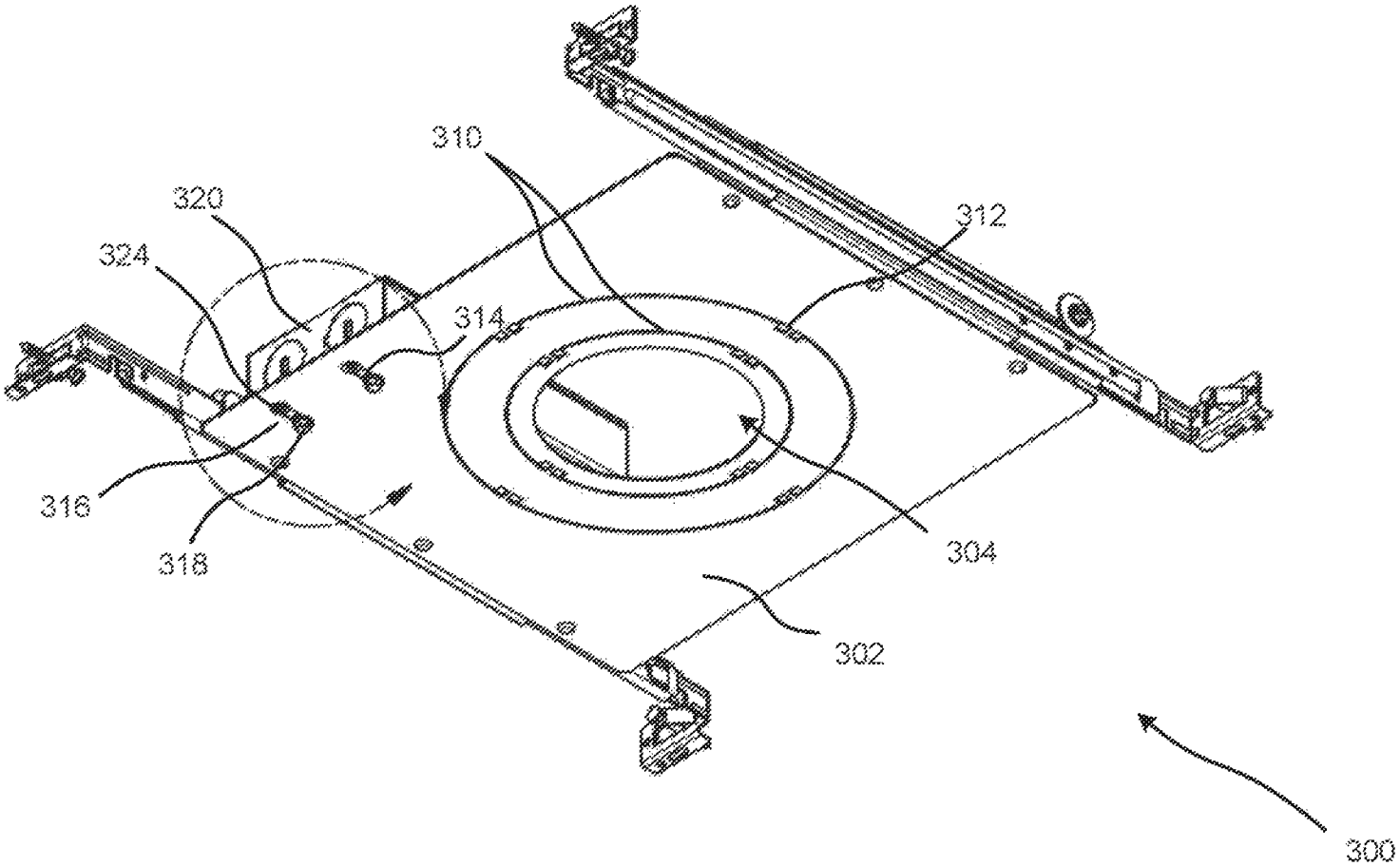
FIG. 4C illustrates the quick-connect mounting mechanism of the mounting pan of FIG. 3 in full engagement with the electrical junction box.
Figure 4D:
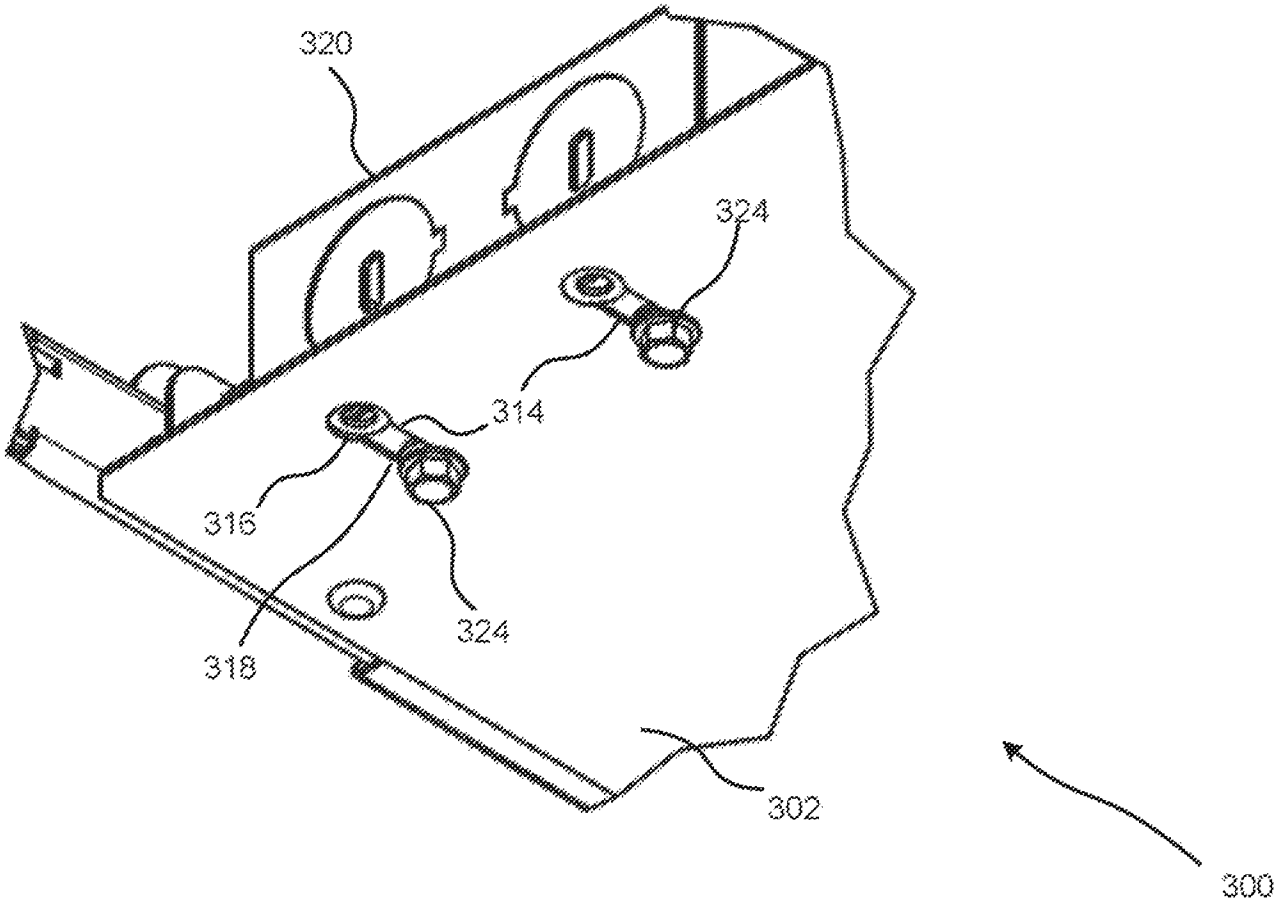
FIG. 4D is an enlarged view of the quick-connect mounting mechanism engagement shown in FIG. 4C.

FIGS. 4A-4D illustrate an electrical junction box 320 being interfaced with the mounting pan 300 of FIG. 1. Electrical junction box 320 may be similar to electrical junction box 120 described above and may define at least one electrical port (not shown) that provides a location for a connector to electrically couple the electrical junction box 320 to a light fixture mounted on the mounting pan 300. Electrical junction box 320 further includes at least one quick-connect mounting mechanism that interfaces with the quick-connect mounting mechanism of the mounting pan 300. In the illustrated embodiment, the quick-connect mounting mechanism of the electrical junction box 320 includes a number of protruding studs 324, which may be formed from screws and/or other objects. Each stud 324 may be similar to the studs 114 described above and may include a head 326 that projects downwardly from the base 330 of the electrical junction box 320 via a shaft (not shown) as best illustrated in FIG. 4D. In some embodiments, each stud 324 may include a friction element (not shown) positioned between the head 326 and a surface of the base 330. The friction elements may be similar to friction element 118 described above. In embodiments in which each stud 324 is in the form of a screw and/or other threaded and/or adjustable member, the height that the head 326 extends above the surface of the base 330 may be adjusted, such as by tightening and/or loosening the screw.

To interface the quick-connect mechanisms from the electrical junction box 320 and the mounting pan 300, the electrical junction box 320 may be positioned above the mounting pan 300 such that each of the studs 324 on the electrical junction box 320 is positioned above and in alignment with the first portion 316 of a respective one of the slots 314 of the mounting pan 300 as shown in FIG. 4A. The first portion 316 of each slot 314 may be configured to receive the head 326 of one of the studs 324 of the electrical junction box 320 as shown in FIG. 4B. Once the heads 326 are inserted through each of the first portions 316 of the slots 314, the electrical junction box 320 may be slid relative to the mounting pan 300 in a direction that moves the head 326 of each stud 324 toward the second portion 318 of each slot 314 until a shaft of each stud 324 contacts an end of the second portion 318 as shown in FIGS. 4C and 4D. The heads 326 are designed to have a wider dimension than the width of the second portion 318 such that when positioned within the second portion 318, a portion of each of the heads 326 extends beyond an outer periphery of the second portion 318 of each slot 314 so as to prevent the electrical junction box 320 from being moved relative to the mounting pan 300 as described in relation to FIGS. 2A-2E above.

Figure 5:
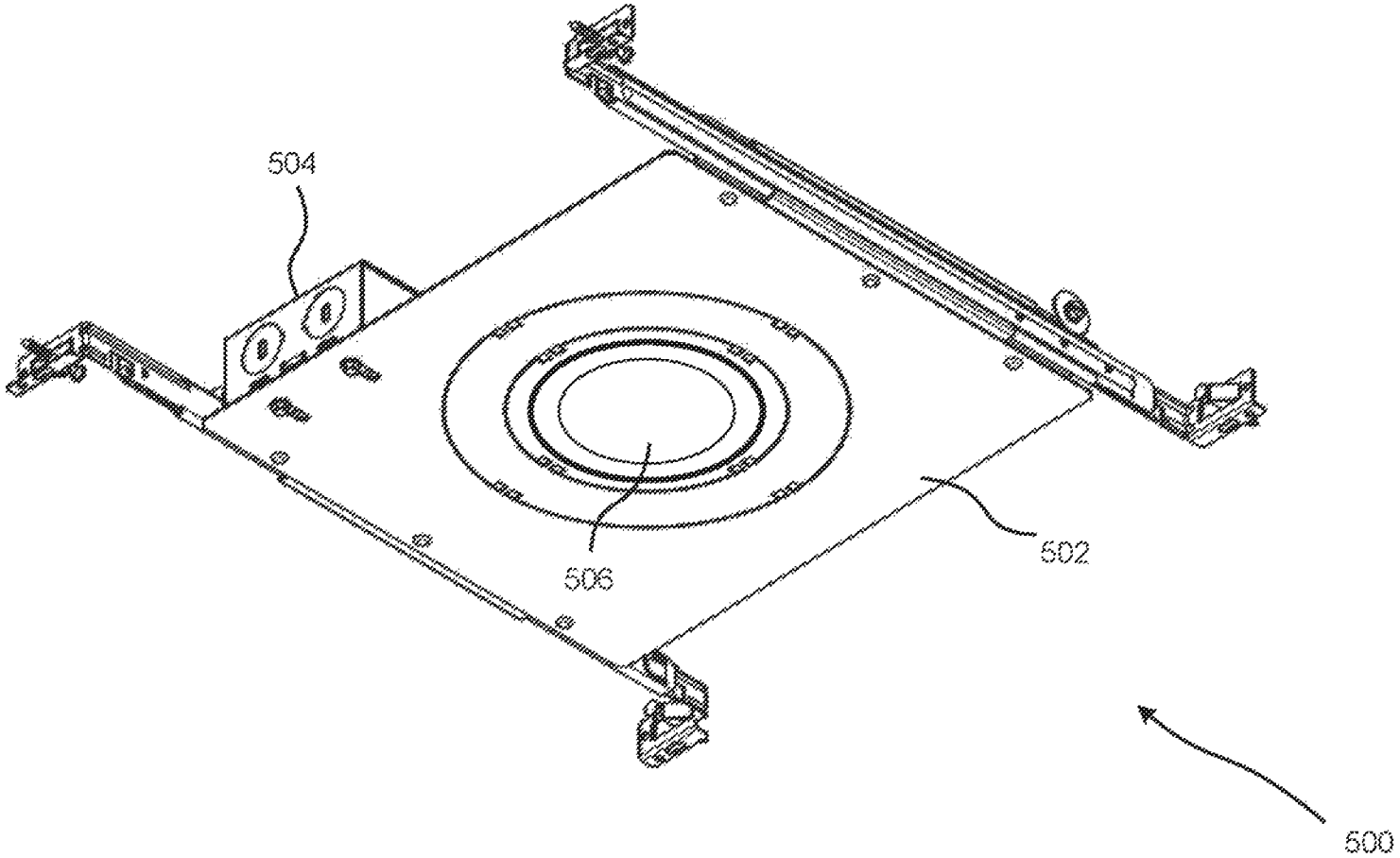
FIG. 5 illustrates a recessed light fixture assembly according to embodiments of the invention.

FIG. 5 depicts a recessed lighting fixture assembly 500 according to embodiments of the invention. The assembly 500 may include a mounting pan 502 and electrical junction box 504 that are coupled to one another using corresponding quick-connect mounting mechanisms such as described above. Mounting pan 502 and electrical junction box 504 may be similar to those described above. While shown with quick-connect mounting mechanisms similar to those used in mounting pan 300 and electrical junction box 320, it will be appreciated that in some embodiments mounting pan 502 and electrical junction box 504 may have quick-connect mounting mechanisms similar to those used in mounting pan 100 and electrical junction box 120. Assembly 500 also includes a light fixture 506 that is configured to be secured to the mounting pan 502 such that light emitted by the light fixture 506 extends through the pan opening (not shown). While illustrated as being circular, it will be appreciated that light fixture 506 may have any cross-sectional size. Once assembly 500 is installed, an electrical line may be routed to the electrical junction box 504 and a cable may be used to electrically couple the light fixture 506 and the electrical junction box 504 to supply power to the light fixture 506.

While the embodiments above depict electrical junction boxes being secured to mounting pans using quick-connect mounting mechanisms that involve the interfacing of two slots and studs, it will be appreciated that any arrangement of any number of slots and studs may be used to secure electrical junction boxes to mounting pans. Typically, quick-connect mounting mechanisms having two or more studs and slots are used to ensure that rotation of the electrical junction box relative to the mounting pan is constrained, however in some embodiments a single slot/stud may be positioned close enough to a sidewall of the mounting pan such that the sidewall can serve to prevent rotation of the electrical junction box.

Additionally, while described having quick-connect mounting mechanisms that are formed using slot/stud interfaces, it will be appreciated that other quick-connect mounting mechanisms may be used that allow for a sliding connection to be made between an electrical junction box and a mounting pan. For example, a sliding rail systems, snaps, and/or other quick-connect mechanisms that do not need separate tools to engage or disengage may be used in conjunction with the mounting pans and electrical junction boxes disclosed herein.

Figure 6:
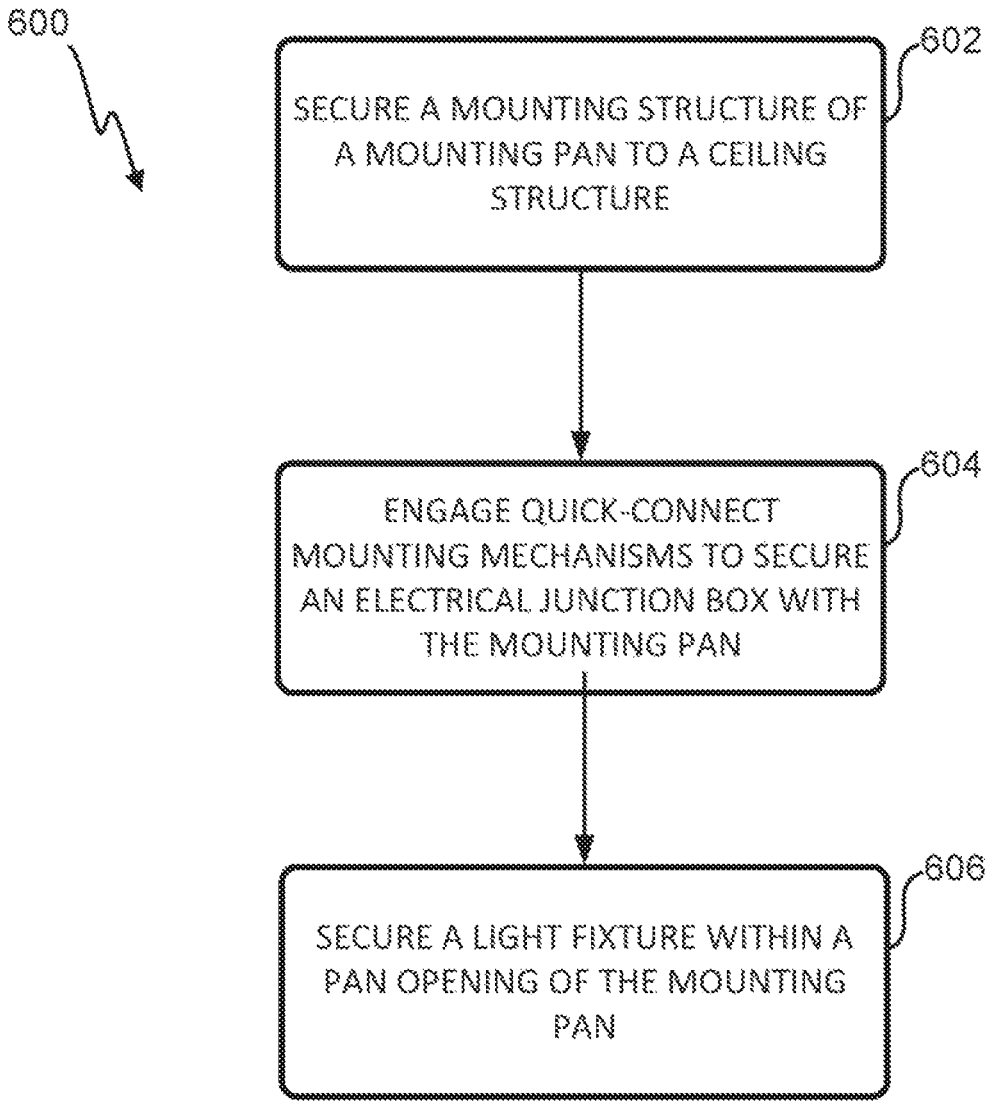
FIG. 6 is a flowchart depicting a process for installing a recessed light fixture assembly according to embodiments of the invention.

FIG. 6 is a flowchart illustrating one embodiment of a process 600 for installing a light fixture. Process 600 may be performed using any of the mounting pans and/or electrical junction boxes described herein. Process 600 may begin at block 602 by securing a mounting structure of a mounting pan to a ceiling structure. For example, opposing ends of mounting brackets of the mounting pan may be fastened to adjacent ceiling joists or other structural features of the ceiling to secure the mounting pan onto the ceiling structure. At block 604, a quick-connect mounting feature of an electrical junction box may be secured with a quick-connect mounting feature of the mounting pan to secure the electrical junction box with the mounting pan. In some embodiments, the quick-connect mounting mechanisms may include a plurality of elongated slots and studs, as described above.

At block 606, process 600 may include securing the light fixture within a pan opening defined by the mounting pan. In some embodiments, the mounting pan includes one or more slots surrounding the pan opening, as described above. In some embodiments, process 600 includes severing the plurality of retention tabs and removing a portion of the mounting pan positioned between the slot and the pan opening, thereby expanding a size of the pan opening prior to securing the light fixture within the pan opening. This allows the pan opening to be modified to accommodate a larger and/or different sized light fixture.

Process 600 is not limited to the specific order set forth in FIG. 6. Moreover, embodiments of the invention may not involve performance of all of the blocks set forth in FIG. 6. For example, the mounting pans of some embodiments of the present invention may be devoid of sizing slots (such that block 606 is not performed) while the mounting pans of other embodiments of the present invention may be devoid of quick-connect mounting features (such that block 604 is not performed).

The methods, systems, and devices discussed above are examples. Some embodiments were described as processes depicted as flow diagrams or block diagrams. Although each may describe the operations as a sequential process, many of the operations can be performed in parallel or concurrently. In addition, the order of the operations may be rearranged. A process may have additional steps not included in the figure.

It should be noted that the systems and devices discussed above are intended merely to be examples. It must be stressed that various embodiments may omit, substitute, or add various procedures or components as appropriate. Also, features described with respect to certain embodiments may be combined in various other embodiments. Different aspects and elements of the embodiments may be combined in a similar manner. Also, it should be emphasized that technology evolves and, thus, many of the elements are examples and should not be interpreted to limit the scope of the invention.

Specific details are given in the description to provide a thorough understanding of the embodiments. However, it will be understood by one of ordinary skill in the art that the embodiments may be practiced without these specific details. For example, well-known structures and techniques have been shown without unnecessary detail in order to avoid obscuring the embodiments. This description provides example embodiments only, and is not intended to limit the scope, applicability, or configuration of the invention. Rather, the preceding description of the embodiments will provide those skilled in the art with an enabling description for implementing embodiments of the invention. Various changes may be made in the function and arrangement of elements without departing from the spirit and scope of the invention.

Having described several embodiments, it will be recognized by those of skill in the art that various modifications, alternative constructions, and equivalents may be used without departing from the spirit of the invention. For example, the above elements may merely be a component of a larger system, wherein other rules may take precedence over or otherwise modify the application of the invention. Also, a number of steps may be undertaken before, during, or after the above elements are considered. Accordingly, the above description should not be taken as limiting the scope of the invention.

Also, the words "comprise", "comprising", "contains", "containing", "include", "including", and "includes", when used in this specification and in the following claims, are intended to specify the presence of stated features, integers, components, or steps, but they do not preclude the presence or addition of one or more other features, integers, components, steps, acts, or groups.

Unless defined otherwise, all technical and scientific terms used herein have the same meaning as commonly or conventionally understood. As used herein, the articles "a" and "an" refer to one or to more than one (i.e., to at least one) of the grammatical object of the article. By way of example, "an element" means one element or more than one element. "About" and/or "approximately" as used herein when referring to a measurable value such as an amount, a temporal duration, and the like, encompasses variations of ±20% or ±10%, ±5%, or ±0.1% from the specified value, as such variations are appropriate to in the context of the systems, devices, circuits, methods, and other implementations described herein. "Substantially" as used herein when referring to a measurable value such as an amount, a temporal duration, a physical attribute (such as frequency), and the like, also encompasses variations of ±20% or ±10%, ±5%, or ±0.1% from the specified value, as such variations are appropriate to in the context of the systems, devices, circuits, methods, and other implementations described herein.

As used herein, including in the claims, "and" as used in a list of items prefaced by "at least one of" or "one or more of" indicates that any combination of the listed items may be used. For example, a list of "at least one of A, B, and C" includes any of the combinations A or B or C or AB or AC or BC and/or ABC (i.e., A and B and C). Furthermore, to the extent more than one occurrence or use of the items A, B, or C is possible, multiple uses of A, B, and/or C may form part of the contemplated combinations. For example, a list of "at least one of A, B, and C" may also include AA, AAB, AAA, BB, etc.

What is claimed is:

1. A recessed lighting fixture assembly, comprising:

a mounting pan comprising:

a mounting structure that is configured to be coupled to a ceiling; and a pan base coupled with the mounting structure, the pan base defining a pan opening, wherein the pan base comprises a first quick-connect mounting feature;

a light fixture configured to be secured to the mounting pan such that a portion of the light emitted by the light fixture will emit through the pan opening; and an electrical junction box that is configured to supply power to the light fixture, wherein:

the electrical junction box comprises a second quick-connect mounting feature that is configured to engage with the first quick-connect mounting feature to secure the electrical junction box to the mounting pan;

one of the first quick-connect mounting feature or the second quick-connect mounting feature comprises a plurality of elongated slots, each of the elongated slots having a first end having a lateral dimension and a second end having a lateral dimension, the lateral dimension of first end being greater than the lateral dimension of the second end; and another of the first quick-connect mounting feature or the second quick-connect mounting feature comprises a plurality of protruding studs, each of the protruding studs having a head, the head having a lateral dimension greater than the lateral dimension of the second end and smaller than the lateral dimension of the first end, wherein each head is configured to be inserted into the first end of one of the plurality of elongated slots and slid toward the second end to secure the head within the one of the plurality of elongated slots.

2. The recessed lighting fixture assembly of claim 1, wherein:

each of the protruding studs comprises a friction element positioned between the head and a surface of the another one of the first quick-connect mounting feature or the second quick-connect mounting feature, the friction element being configured to maintain the head at a position within the elongated slot.

3. The recessed lighting fixture assembly of claim 1, wherein:

the mounting pan defines a slot formed about the pan opening, the slot being discontinuous such that a plurality of retention tabs connect adjacent portions of the pan base on either side of the slot.

4. The recessed lighting fixture assembly of claim 3, wherein:

the plurality of retention tabs are configured to be severed to remove a portion of the pan base positioned between the slot and the pan opening, thereby expanding a size of the pan opening.

5. The recessed lighting fixture assembly of claim 1, wherein:

the first quick-connect mounting feature comprises a plurality of connectors spaced apart from one another to provide multiple mounting positions for the electrical junction box.

6. The recessed lighting fixture assembly of claim 5, wherein:

at least some of the plurality of connectors are spaced apart at irregular intervals.

* * * * *